United States Patent [19]

Roux

[11] 4,135,416

[45] Jan. 23, 1979

[54] TOOL FOR OPENING AND CLOSING WRIST WATCHES

[76] Inventor: Jean Roux, Clos-à-Bec, La Sagne, Switzerland, 2314

[21] Appl. No.: 843,283

[22] Filed: Oct. 18, 1977

[51] Int. Cl.[2] ..... B25B 7/00; G04D 3/00

[52] U.S. Cl. ..... 81/5.1 R; 81/6; 81/421

[58] Field of Search ..... 81/5.1 R, 6, 418, 421; 29/807

[56] References Cited

U.S. PATENT DOCUMENTS

| | | | |
|---|---|---|---|
| 1,176,604 | 3/1916 | Sanders | 81/5.1 R |
| 1,640,883 | 8/1927 | Coleman | 81/5.1 R |
| 2,541,431 | 2/1951 | Muehlbauer | 81/6 |
| 4,073,179 | 2/1978 | Hickey | 81/5.1 R X |

FOREIGN PATENT DOCUMENTS

| | | | |
|---|---|---|---|
| 1068390 | 6/1954 | France | 81/421 |

*Primary Examiner*—James L. Jones, Jr.
*Assistant Examiner*—James G. Smith
*Attorney, Agent, or Firm*—Sherman & Shalloway

[57] ABSTRACT

A tool for opening and closing wrist-watches, and more particularly tight-fitting wrist watches, is disclosed which is in the form of adjustable pliers, the jaws of which mainly have an inner flat surface covered with protective pads, the tip of one of said jaws consisting of a transversal protrusion preceded by a recess, the tip of the other of said jaws consisting of a slanting flat surface.

3 Claims, 2 Drawing Figures

TOOL FOR OPENING AND CLOSING WRIST WATCHES

BACKGROUND OF THE INVENTION

The present invention relates to the repair of watches and is concerned more particularly with a tool that can be used for opening as well as for closing wrist-watches of the pressure-closing type.

BRIEF DISCUSSION OF THE PRIOR ART

Watch cases of current watches are most often made with a tight-fitting back. A dent is usually provided in the joint between the back and the middle of the watch-case to facilitate the introduction of a sharp edged-tool for opening the watch-case.

Heretofore, tight-fitting watch cases have generally been opened by introducing the blade of a knife or similar sharp wedge in the joint. It has been proposed in U.S. Pat. No. 478,615 a tool for opening tight-fitting watch cases consisting of a steel plate with two wedge-shaped projecting edges fixed to a wooden handle. When the watch case is new and very tightly-fit, as is the case with water-tight watch-cases, prior means require the force of both hands to open said watch-case. Moreover, injury to the hand can easily be caused by a slip of the tool. Also the sharp wedges of prior means could easily either be damaged or cause damage to the watch-case or watch-interior due to uncontrollable movements resulting from the extreme force exerted on said tools.

Proposed means for closing tight-fitting watch cases generally consist of special-purpose manually driven presses.

Therefore, prior means for opening and closing tight-fitting watch cases have not been found entirely satisfactory.

SUMMARY OF THE INVENTION

In general, the preferred form of the present invention comprises a pair of adjustable pliers having a pair of handles joined by a pivoting point whose position is adjustable with respect to one of the handles, each handle having a jaw extending approximately forwardly therefrom on opposite sides of the hinge point as the handle. The first of the jaws has mainly an inner flat surface covered with protective pads followed by a recess and terminating by a transversal wedge-type protrusion the height of which remains below the level of said inner surface. The second of the jaws has mainly an inner flat surface also covered with protective pads, approximately opposite to the inner flat surface of the first jaw and intended to cooperate with said first jaw in closing a watch-case, one jaw pressing on the upper surface of the watch-case, the other on the back when closing the handles. The second of the jaws terminates in a small portion of slanting surface cooperating with the protrusion of the first jaw when opening a tight-fitting watch-case.

OBJECTS OF THE INVENTION

It is an object of the present invention to provide an inexpensive tool for opening and closing tight-fitting watch-cases.

It is a further object of the present invention to provide a tool which will apply a pressing force on the upper part of a tight-fitting watch-case and on the back for closing the watch-case.

It is another object of the present invention to provide a tool which engages in a dent of the joint of a tight-fitting watch-case and keeps hold of the back of said watch-case.

It is another object of the present invention to provide a tool which opens and closes a tight-fitting watch-case without damage to the watch-case or to the interior of the watch.

It is another object of the present invention to provide a tool which opens a tight-fitting watch-case without injury.

It is yet another object of the present invention to provide a tool for opening and closing tight-fitting watch-cases of all shapes and sizes.

BRIEF DESCRIPTION OF THE DRAWINGS

These and other objects of the invention may be better understood from the following description and accompanying drawings in which.

DETAILED DESCRIPTION OF THE PREFERRED EMBODIMENT

Figure 1:
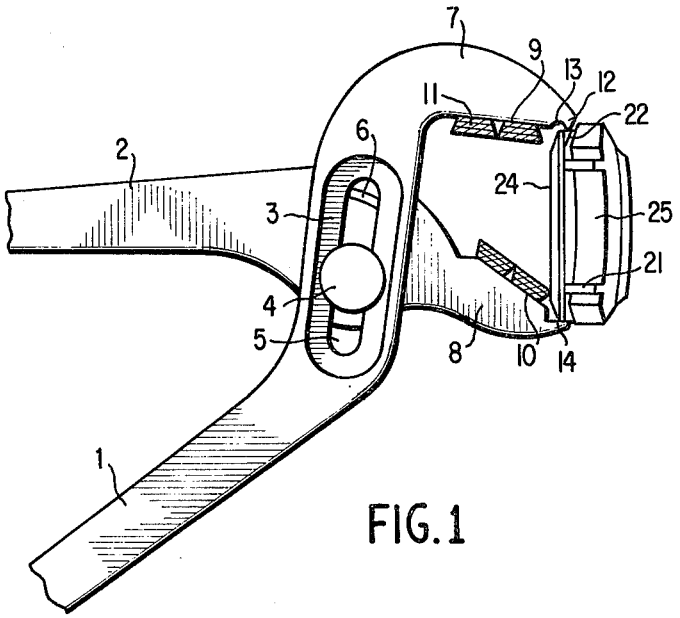
FIG. 1 is a side view of the preferred form of the tool for opening and closing wrist-watches according to the present invention shown opening a wrist-watch.
Figure 2:
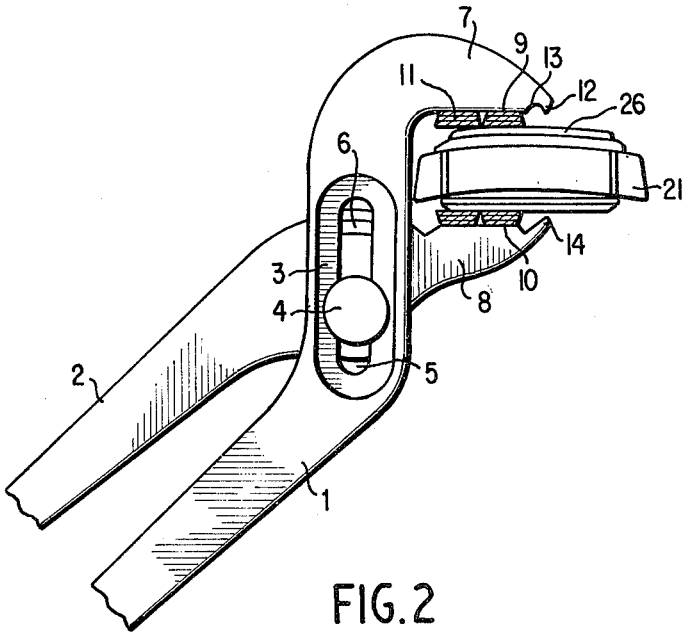
FIG. 2 is another side view thereof, shown closing a wrist-watch.

As shown in FIGS. 1 and 2, the preferred form of the tool for opening and closing wrist-watches of the present invention comprises a pair of handles 1 and 2 linked to each other by means of an adjustable hinge 3 comprising a pin 4, fixed to one of the handles, capable of pivoting in an elongated opening 5 of the other handle and comprising means 6 for maintaining the pivoting point in a steady position except when the handles are completely open. The handles 1 and 2 have approximately forward extensions, or jaws 7 and 8 respectively, which extend on opposite sides of the hinge point with respect to their handles 1 and 2, forming two crossed and pivoted levers.

The inner surface 9 and 10 of each jaw 7 and 8 is approximately flat and is provided with one or more protective pads 11. The protective pads can be made of rubber, plastic, teflon or any other suitable material.

The extremity of one jaw 7 comprises a transversal wedge-type protrusion 12 preceded by a recess 13. The protrusion 12 does not extend beyond the level of the inner surface 9.

The extremity of the other jaw 8 comprises a slanting surface 14 which preferably does not extend beyond the level of the inner surface 10.

A tight-fitting wrist-watch 21 can be opened as shown in FIG. 1. The wedge-type protrusion 12 is engaged in a dent 22 of the joint 23 between the back 24 and the middle 25 of the watch-case 21. The slanting surface 14 of the tool is leaned against the back of the watch at a point approximately diametrically opposite the dent 22. When pressing on the handles 1 and 2 of the tool according to the present invention, a closing effort is transmitted to the jaws 7 and 8. The wedge-type protrusion 12 penetrates further into the dent 22 of the watch-case, and in so doing separates the back 24 from the middle 25 until they no longer hold to each other. The back 24 of the watch 21 remains locked in the tool between recess 13 and surface 14. The jaws are thus prevented from closing any further and from scratching or damaging any part of the open watch, or from causing any injury. Usually the leverage of the tool is sufficient to open a watch-case with just the force of the right hand, enabling to receive the freed part in the cupped left hand.

For closing a tight-fitting watch with the tool according to the present invention and as shown in FIG. 2, the back of the watch is placed in front of the opening of the upper part of the watch between the jaws 7 and 8 of the tool, which is then used as a pair of pliers for snapping shut the watch-case. The peotective pads 11 avoid damages to the watch-case and enable high pressures to be exerted even on the glass 26 without breaking it. The watch-case is more conveniently closed by exerting successive small efforts all around its circumference until the back locks into position.

Since neither the protrusion 12 nor the slanting surface 14 extend beyond the corresponding inner surfaces 9 and 10, no damage to the watch-case can result from these parts when closing the watch, the more so since the protective pads 11 offer a safety margin between such sharp edges and the watch-case.

The adjustable hinge position enables the use of the tool for opening and closing tight-fitting watch cases of any size or thickness.

Jaws 7 and 8 preferably have a slanting orientation with regard to the handles 1 and 2 in order to obtain practically parallel inner surfaces 9 and 10 at any hinge position when handles 1 and 2 are close together. This feature facilitates the use of the tool according to the invention for closing watch-cases.

What is claimed is:

1. A tool for opening and closing tight-fitting watch-cases comprising:

a handle portion and a forward extension hinge means intermediate said levers for closing said forward extensions when said handles are moved together, a first of said forward extensions having an approximately flat inner surface covered with protective paddings, a recess adjacent said inner surface and terminating by a transversal wedge-type protrusion the height of which remains under the level of said inner surface, the other of said forward extensions having an approximately flat inner surface covered with protective paddings intended to cooperate with said first inner surface in closing the watch-case, one forward extension pressing on the upper surface of the watch-case, the other forward extension pressing on the back of the watch-case when moving handles together, followed by a portion of slanting surface cooperating with the protrusion of the first forward extension when opening a tight-fitting watch-case.

2. The tool for opening and closing tight-fitting watch-cases of claim 1 in which the position of said hinge is adjustable.

3. The tool for opening and closing tight-fitting watch-cases of claim 1 in which the forward extensions have a slanting orientation with regard to the handles.

* * * * *